US005295547A

United States Patent [19]

Coelho et al.

[11] Patent Number: 5,295,547

[45] Date of Patent: Mar. 22, 1994

[54] MULTIPLEXED ELECTROHYDRAULIC TYPE OF CONTROL SYSTEM FOR USE IN UNDERSEA PRODUCTION SYSTEM

[75] Inventors: Eduardo J. de Jesus Coelho; Mauro Luiz L. Euphemio; Ricardo M. Freitas; Fábio K. P. Conti, all of Rio de Janeiro, Brazil

[73] Assignee: Petroleo Brasileiro S.A. Petrobras, Rio De Janeiro, Brazil

[21] Appl. No.: 970,200

[22] Filed: Nov. 2, 1992

[30] Foreign Application Priority Data

Nov. 1, 1991 [BR] Brazil ..... PI 9104764

[51] Int. Cl.[5] ..... E21B 43/00

[52] U.S. Cl. ..... 166/368

[58] Field of Search ..... 166/366-368

[56] References Cited

U.S. PATENT DOCUMENTS

| | | | |
|---|---|---|---|
| 4,378,848 | 4/1983 | Milberger | 166/368 X |
| 4,848,475 | 7/1989 | Dean et al. | 166/368 X |
| 5,025,865 | 6/1991 | Caldwell et al. | 166/368 X |

*Primary Examiner*—Thuy M. Bui

*Attorney, Agent, or Firm*—Sughrue, Mion, Zinn, Macpeak & Seas

[57] ABSTRACT

This invention concerns a multiplexed electrohydraulic kind of control system consisting of ten undersea control modules, (24), arranged and installed one for each local Xmas tree (14) and satellite Xmas module (18). System links up with a stationary production system by two hydraulic umbilicals, (42), and one electric umbilical, (44), this latter through an electric distribution module, (26), while connection of jumper, (84) of undersea control module, (24), and to electric distribution module, (26) is done by a remotely controlled vehicle (R.O.V.), (30).

7 Claims, 12 Drawing Sheets

MULTIPLEXED ELECTROHYDRAULIC TYPE OF CONTROL SYSTEM FOR USE IN UNDERSEA PRODUCTION SYSTEM

FIELD OF INVENTION

This invention concerns a multiplexed electrohydraulic type of control system for use in an undersea production system which enables the valves of each undersea well to be individually controlled by an electronically digited means worked by an operator at a computer which lies in the stationary production unit.

BACKGROUND OF INVENTION

A multiplexed electrohydraulic type of control system has to be provided with some kind of electric power source and means of communication with the control and supervision station, through which to interface with the operator. The ideal way to avoid use of an undersea umbilical with electric cables between the platform and the template would be to provide the undersea control module with its own power supply source and/or place, together with means to enable it to communicate directly with the platform through the undersea environment it which it lies. Furthermore, the need to develop various other kinds of technology connected with idea is why it has not yet gained the degree of reliability and safety needed in the control of undersea production systems.

DESCRIPTION OF PRIOR ART

Within the present state of the art, multiplexed electrohydraulic control systems employ electric umbilicals to provide power and communication for undersea control modules. A big drawback to this has always been the need to have electric connectors lying in the undersea structures and/or equipment whenever two or more modules have to share one same electrical umbilical which generally makes it more difficult to carry out maintenance of the system whenever faults appear in stretches of equipement therein. An example of this would be a template manifold with control modules installed in the Xmas trees, where a mere faulty connector or electric cable within the manifold would mean that production at all wells would have to be stopped and manifold would have to be brought to the surface for the repair of a single connector or electric or, otherwise, multiplexed control over the faulty well would be lost.

SUMMARY OF INVENTION

This invention provides a multiplexed electrohydraulic type of control system which consists of ten undersea control modules arranged and installed as one for each local Xmas tree and module of satellite tree. The system is linked up with a stationary production unit by means of two hydraulic umbilicals and one electric umbilical, the latter through an electric distribution module. In order to avoid the need to recover the manifold in the event of a fault in the jumper or electric connector therein, the connection between the jumper in the undersea control module and electric distribution model is achieved by means of a R.O.V. By allowing such connections to be made and unmade locally, at the template, the electric jumper can be within the template, which in the event of a fault can be remotely disconnected by the R.O.V., thus enabling a new jumper to be cast upon the template and connected at both its ends to the R.O.V., thus leaving the electrical connection.

BRIEF DESCRIPTION OF THE DRAWINGS

The multiplexed electrohydraulic type of control system used for an undersea production system, as in this invention, will now be described in greater detail with the help of the drawings hereto.

DETAILED DESCRIPTION OF INVENTION

Figure 1:
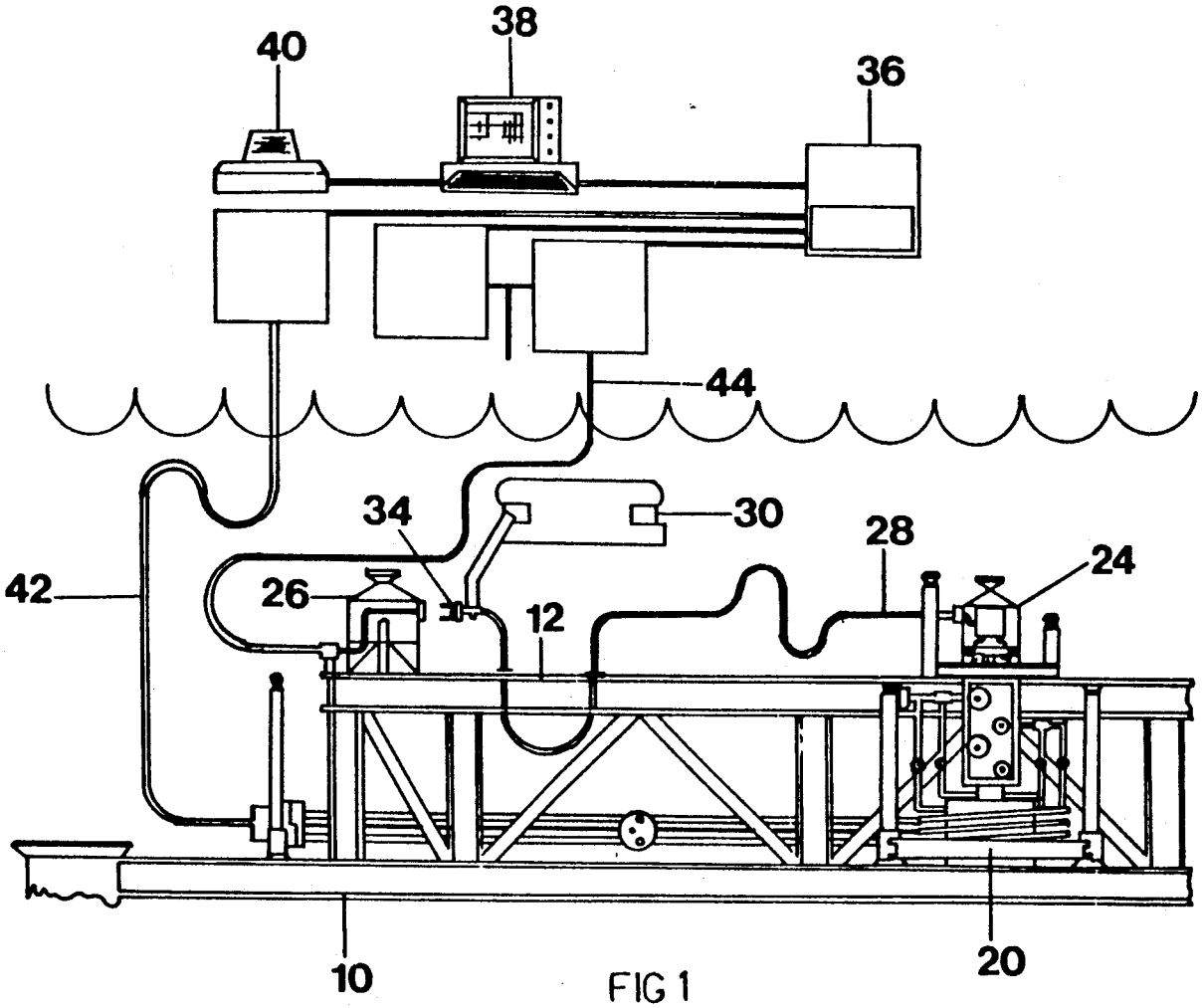
FIG. 1 is a view of connection of jumper to undersea control module and to electric distribution module by means of a remotely operated vehicle—R.O.V.

The multiplexed electrohydraulic control system of this invention is used in an undersea production system of the kind described in the Brazilian patent application Pl 9005123 belonging to the same applicant which amongst other features operates in a 600 m depth of water; while template, 10, and manifold, 12, are separate structures and can be installed separately; manifold, 12, will have four headers: for production, gas-lift, production testing and injecting of water/secondary production; manifold, 12, has blocking valves worked only by remotely controlled vehicle—R.O.V. For local well, all production and control valves for manifold, 12, headers lie in their own Xmas tree (local MXM), 14; interface of template-manifold with satellite well production and control lines will be by means of flow lines structure (F.L.S), 16, of satellite tree module (S.T.M), 18, of respective well. S.T.M, 16 is like an MXM, 20, and may be installed and locked on to any of the ten openings of template, 10, so as to enable manifold, 12, to interface with a satellite well; horizontal connections to be used between manifold, 12, and each local MXM, 14, S.T.M., 18, terminals for hydraulic and electric umbilicals for export-lines, as well as flexible satellite M.X.M.

For this invention the primary control system is to be multiplexed electrohydraulically, and there shall also be a secondary hydraulic system as standby for the first, while inductive type electric connectors are to be employed in the transmitting of all electric power and communications signals. Primary system consists of ten undersea control models (U.C.M.'s), 24, each installed at every local M.X.M, 14, and/or S.T.M. 18. Such modules, 24, are fed hydraulically and electrically by distribution systems installed in the manifold. The hydraulic distribution system is connected to stationary production unit by two umbilicals coming straight from the manifold. For electric distribution there is a junction box known as electric distribution module (E.D.M.), 26, which links this kind of distribution and the electric umbilical to the stationary production unit.

At the stationary production unit, in turn, the control and supervision stations are to be installed, hydraulic and electric suplly units, panels for secondary system and for safety valves (S.C.S.S.V.), stationary production unit connection to umbilicals taking place by means of rapid connecting and disconnecting devices.

Link up with manifold will be done by two hydraulic and one electric umbilicals. Each hydraulic umbilical will consist of:

1 pressure feed line to U.C.M.;

5 pressure lines for secondary control; and 5 pressure lines for S.C.S.S.V.

For undersea hydraulic distribution each WXT, 20 or S.T.M., 18, will be given three control lines by means of its connection with manifold, 12, that is, a hydraulic feed line from its U.C.M., a line to work its secondary control, and a line to work its S.C.S.S.V.

Each U.C.M., 24, will be connected by E.D.M. 26 by means of an electric cable, 28, which will provide energy and communications signals. All electric cables will be installed in manifold, 12, in such a way as to enable it to be connected to the E.D.M., 26, and to the respective U.C.M. 24, by means of an R.O.V., 30, without any help from divers. The great advantage of this system is that in the event of any fault in the cable and/or its electrical connectors, the cable may be disconnected at both ends and replaced by another, which will be lowered and laid upon the manifold, 12; upon connecting up the new cable a connection is restored which would otherwise have been lost, or would at least have taken time and much expense to have worked upon, while undersea electrical connections between umbilical and stationary production unit and each U.C.M. employ induction type connectors.

U.C.M., 24, will be the device which, upon being given a suitable order from control and supervision station will work the corresponding valve. Likewise, regular scanning will take place to update undersea sensor figures. U.C.M., 24, should be a cylindrical container filled with dielectric fluid and should be provided with an outside pressure compensating device. Connection of control lines between U.C.M., 24, and its seat, 32, takes place by means of individual hydraulic connectors for each line; electric connection for undersea transducers also taking place by means of seat, 32, of U.C.M., 24. Such connectors should be of the conducting kind, with a device to keep their electrical contacts protected both during and after desconnecting.

The electrical connection for the cable from E.D.M., 26, is of the induction kind. It will link up with U.G.M. 24, by means of a connector that can be manipulated by an R.O.V., placed in the upper side of the U.C.M. All control and data collecting tasks undertaken by the U.C.M. will be managed by a set of smart electronic circuits, upon receiving orders from the surface, while such circuits will be installed in an airtight container filled with inert gas at atmospheric pressure.

E.D.M., 26, will spread the energy and communications signals from the stationary production unit (S.P.U.) to all the undersea electrohydraulic control modules, 24, and should be installed in a special part of manifold, 12, suitable for horizontal connection with the electrical umbilical locked to template, 10.

The control and supervision station (C.S.S.) will consist of a control panel, 36, and interface with undersea control modules, 24, and a computer, 38, with a printer, 40, for man-machine interface.

The secondary control mode enables operator to keep a well in production directly from the S.P.U. by means of a primary control override. Each local WXT, 14 and S.T.M., 18, are provided with a set of duties in the control lines of which shuttle valves are installed one for each duty. Each well have its own secondary control line from the S.P.U., which line is linked together will all the shuttle valves of this local WXT, 14, or S.T.M., 18, so that its pressurization will keep all duties open with which it is associated.

In view of the foregoing the invention aims at a multiplexed electrohydraulic type of control system to be used in an undersea production system, said control system consisting of ten modules of undersea control (U.C.M.), (24), arranged and installed one for every local wet Xmas tree, 14, and satellite tree model (S.T.M.), (18), which will link up with the stationary production unit by means of hydraulic umbilicals (42) and electric umbilicals (44), the latter through an electric distribution module, (E.D.M.), 26, connection of electric jumper (84) of said undersea control module (U.C.M.) (24), and said electric distribution model (E.D.M.), (26), being done by means of a remotely operated vehicle (R.O.V.), (30).

The primary control system is of the multiplexed electrohydraulic kind, and also includes a secondary hydraulic system as standby for said primary system.

The hydraulic distribuition system is linked to the stationary production unit by hydraulic umbilicals (42), coming directly from manifold, (12), and electrical distribution is provided with an electrical distribution module (E.D.M.), (26), which links this distribution and the electrical umbilical, (44), to the stationary production unit.

Each such hydraulic umbilical, (42), consists of a pressure feed line for said undersea control module (U.C.M.), (24), pressure line for secondary control, and pressure lines for safety valves.

At undersea hydraulic distribution every wet Xmas tree (WXT), (20), or satellite tree module (S.T.M.) (18), receives control lines by means of its connection with the manifold, (12), one of which lines is for hydraulic feed of its undersea control module (U.C.M.) (24), one for working its secondary control, and one to work its safety valve.

All electrical cables, (28), are installed in the manifold, (12), connection of electric cable, (28), to electric distribution module (E.D.M.), (26) and to respective undersea control module (U.C.M.), (24), being achieved by means of a remotely operated vehicle (R.O.V.), (30).

The electrical connection of electrical cable (28), from electric distribution module (E.D.M.), (26), is of the induction kind, said electric cable, (28), being linked to the undersea control module (U.C.M.) (24), by means of a connector, (34) that can be manipulated by a remotely operated vehicle (R.O.V.), (30), lying in the upper side part of said undersea control module (U.C.M.), (24).

A look at FIG. 1 serves to show that the control system is linked up with the stationary production system by means of two hydraulic umbilicals, 42, and one electric umbilical, 44, the latter through an electric distribution module (E.D.M), 26; connection at undersea control module (U.C.M.), (24), and at electrical distribution module (E.D.M), (26), being done by means of a remotely operated vehicle (R.O.V.), 30.

Figure 2:
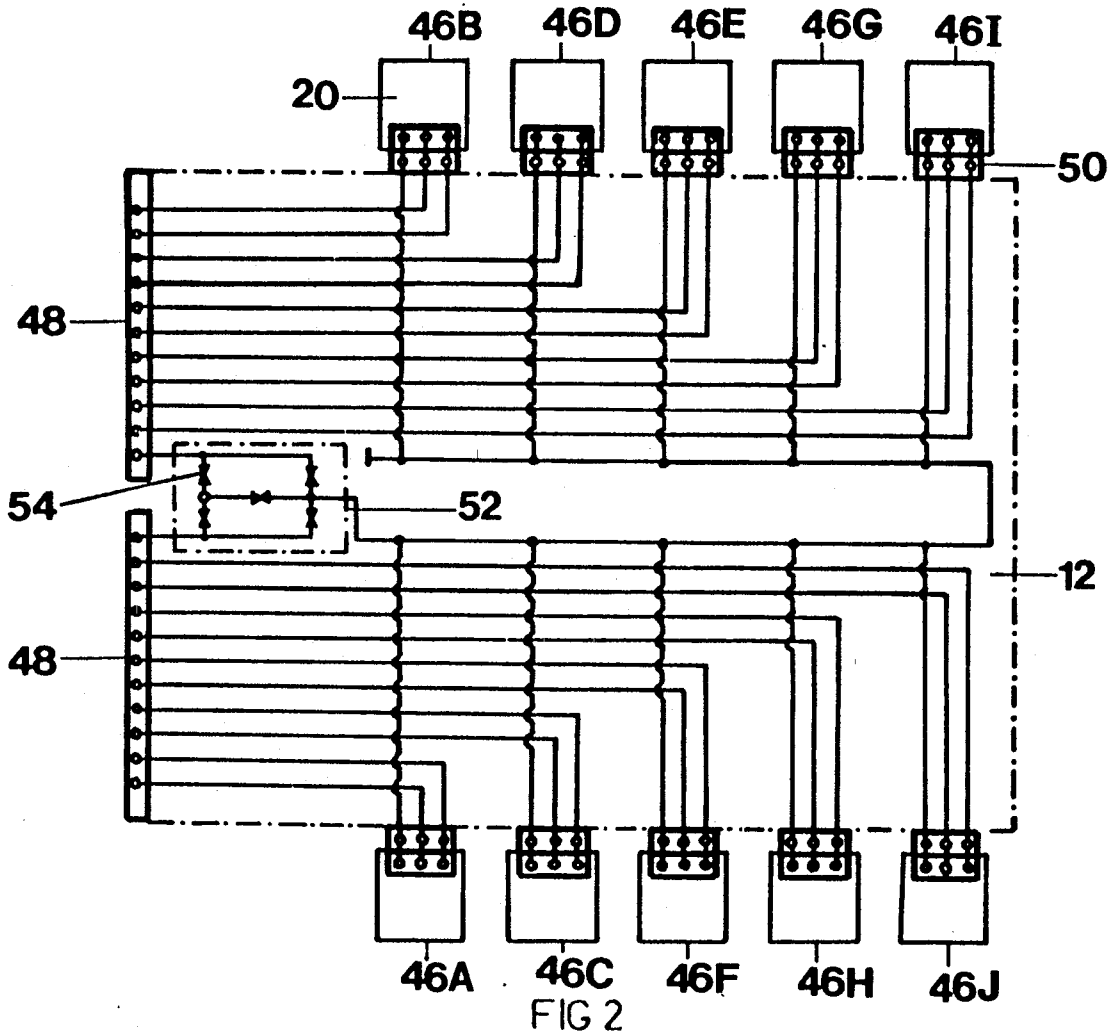
FIG. 2 is a flow chart of the undersea hydraulic arrangement.

FIG. 2 is a flowchart of undersea hydraulic distribution of wells 46A–46J, showing terminals, 48, to connect umbilical to manifold, connection, 50 of manifold, 12, to WXT, 20, a maintenance panel, 52, of hydraulic distribution to operating valves, 54, for R.O.V.

Figure 3:
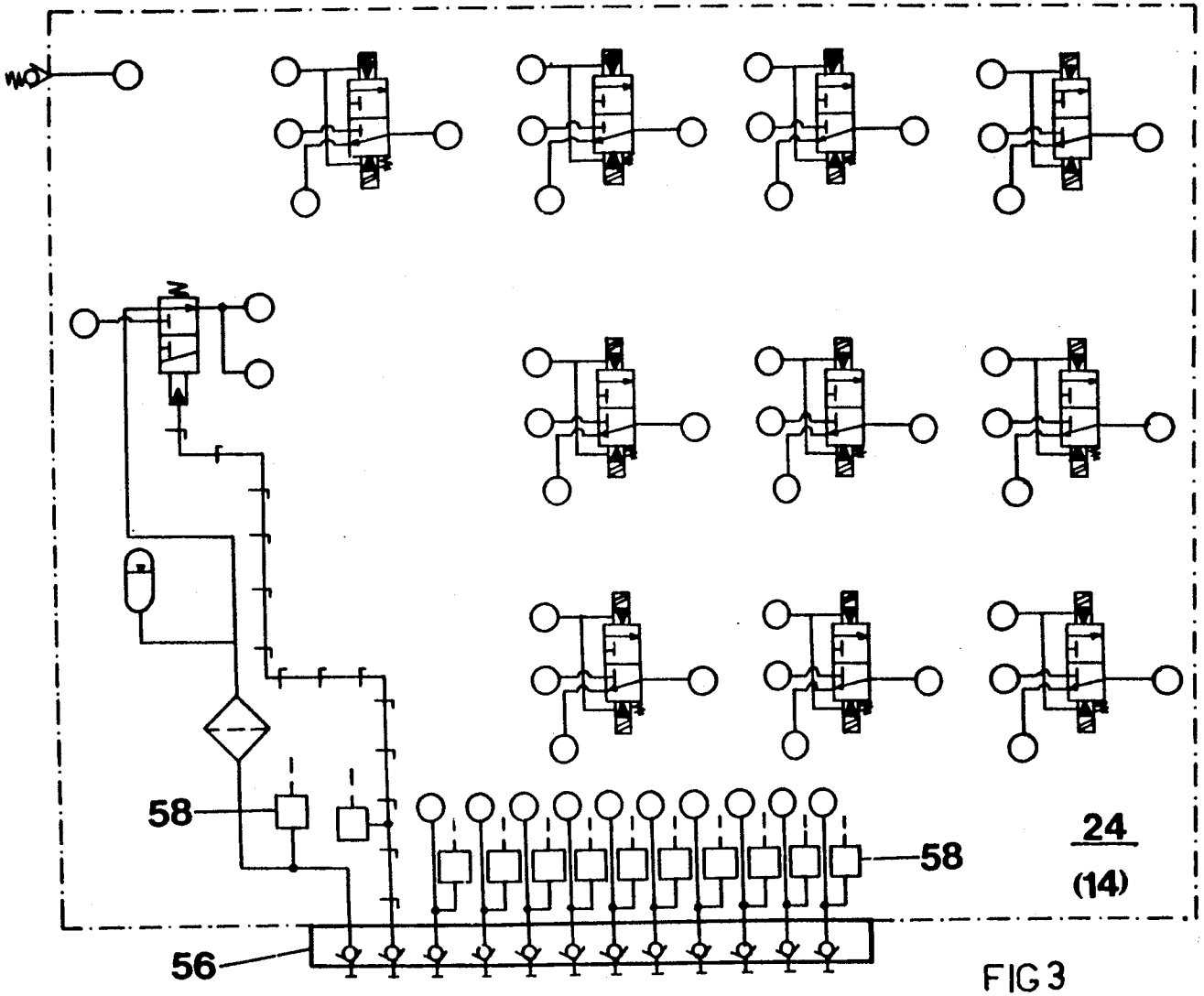
FIG. 3 is a hydraulic flowchart of the connection of undersea control module to a local wet Xmas tree.
Figure 4:
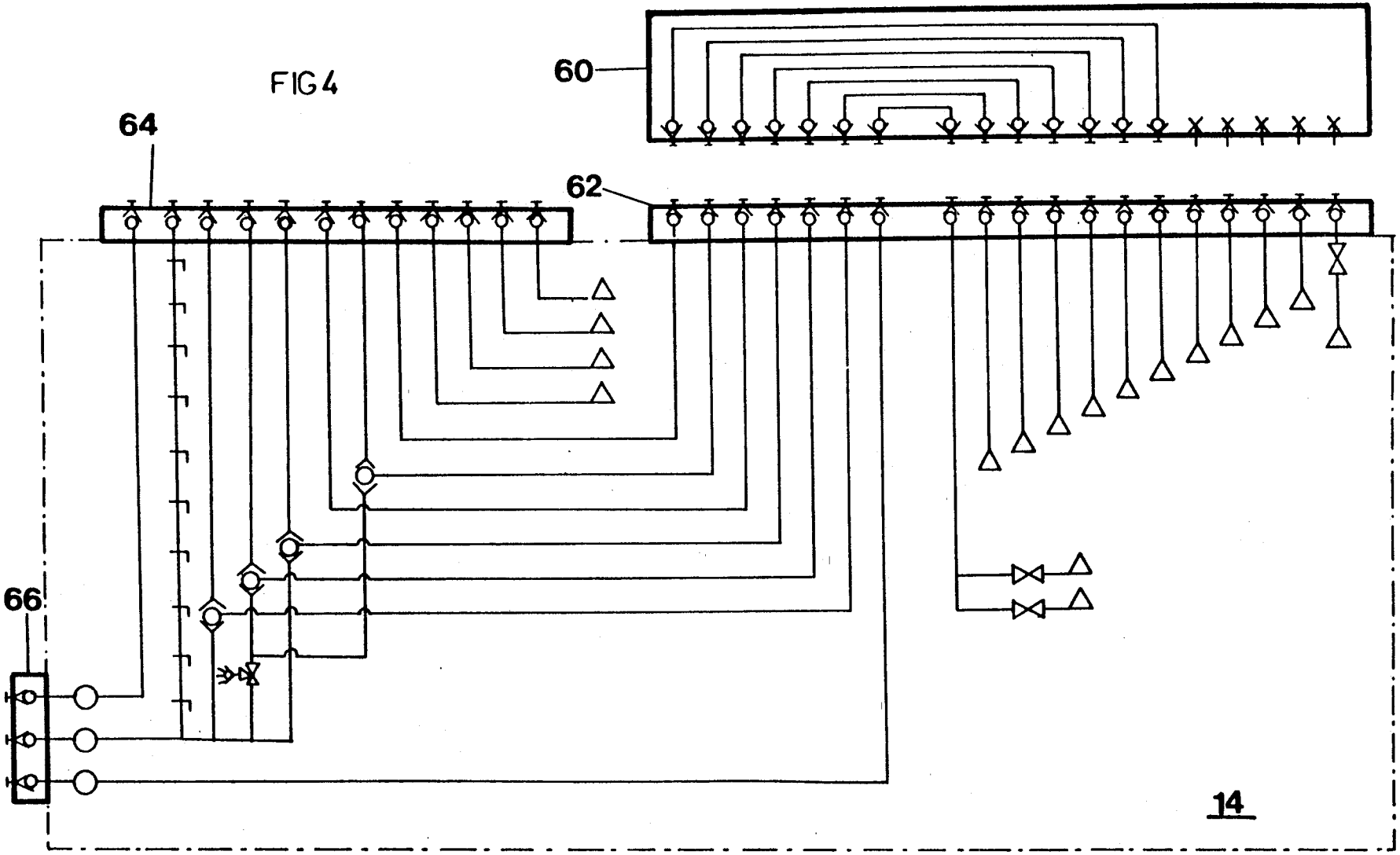
FIG. 4 is a flowchart of hydraulic interfaces with local wet Xmas tree, top of wet tree, cover of wet Xmas tree, bed of undersea control module, and terminal for manifold connection.
Figure 5:
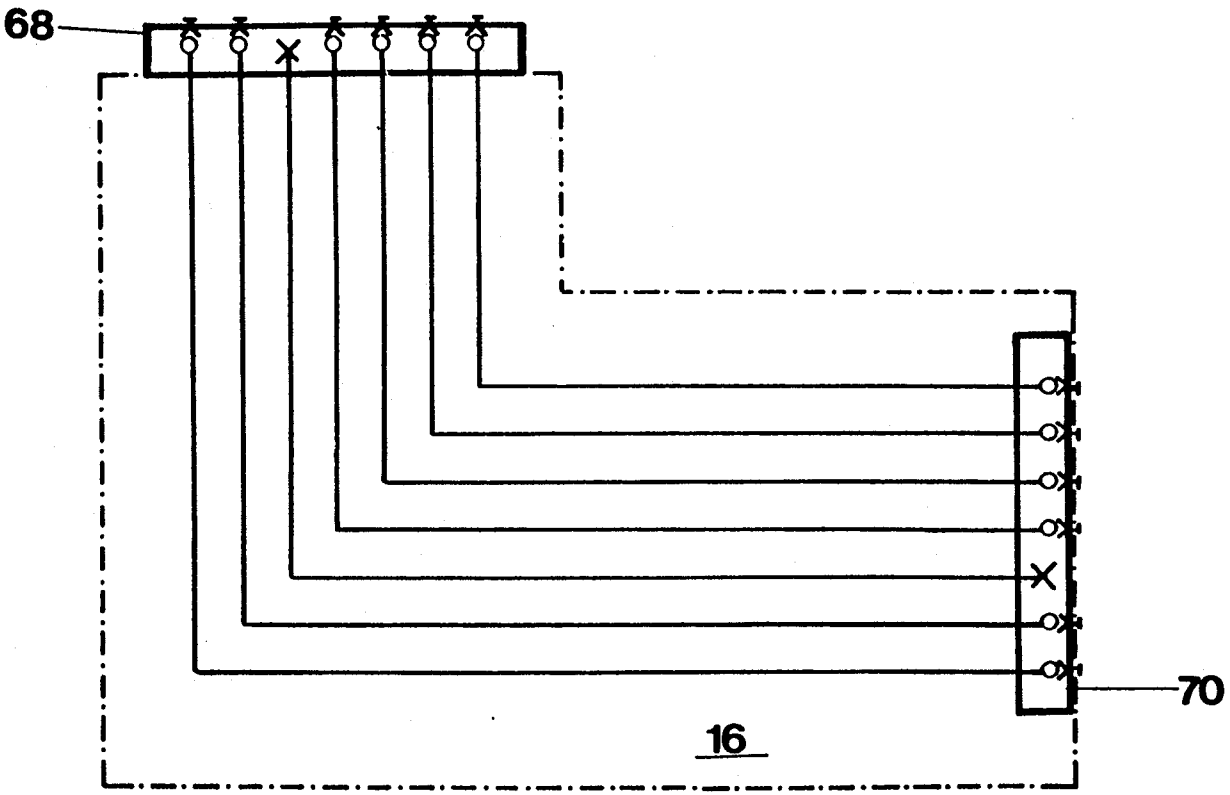
FIGS. 5 and 6 are flowcharts of hydraulic interfaces with satellites tree module and structure of flow line.
Figure 6:
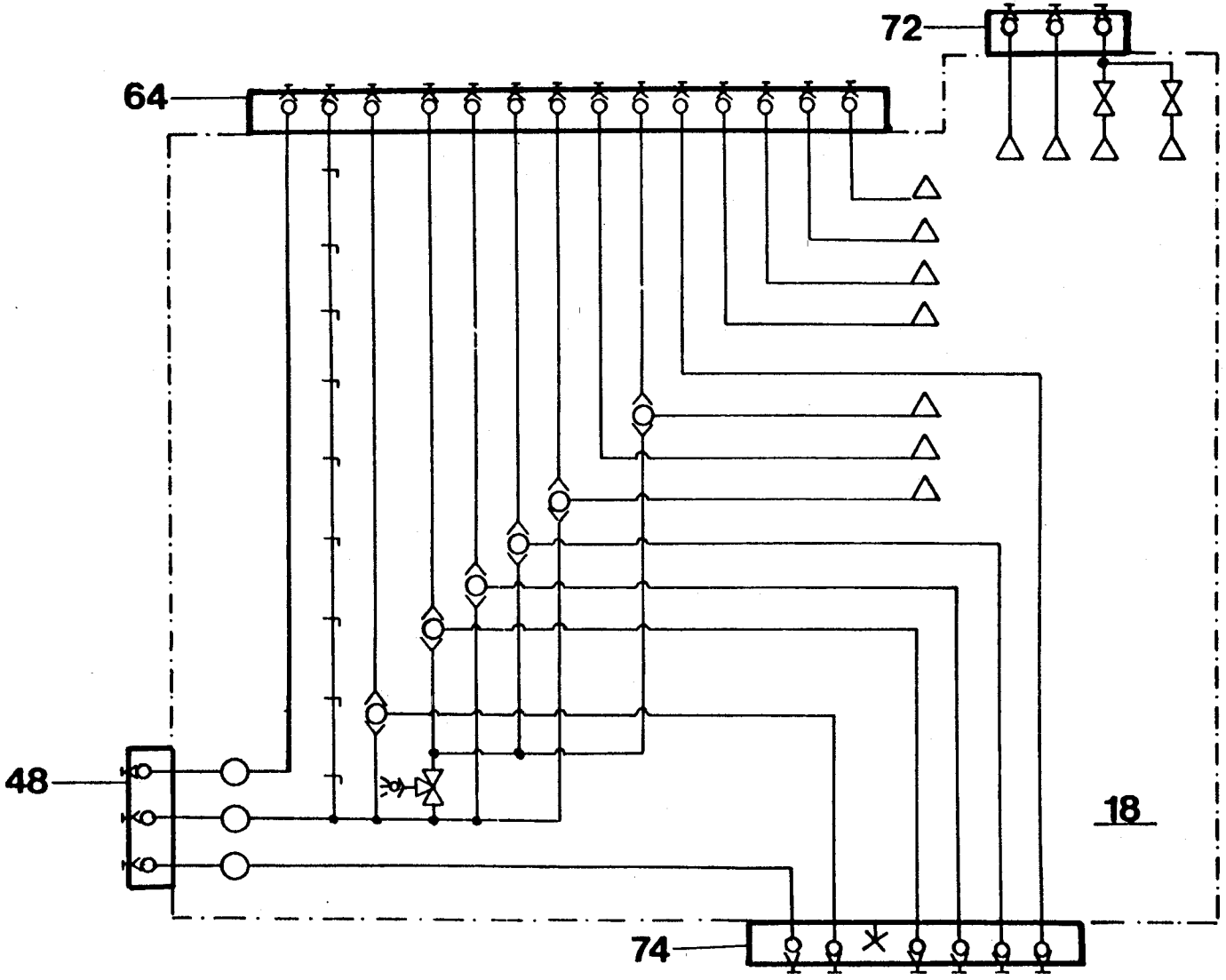
Figure 7:
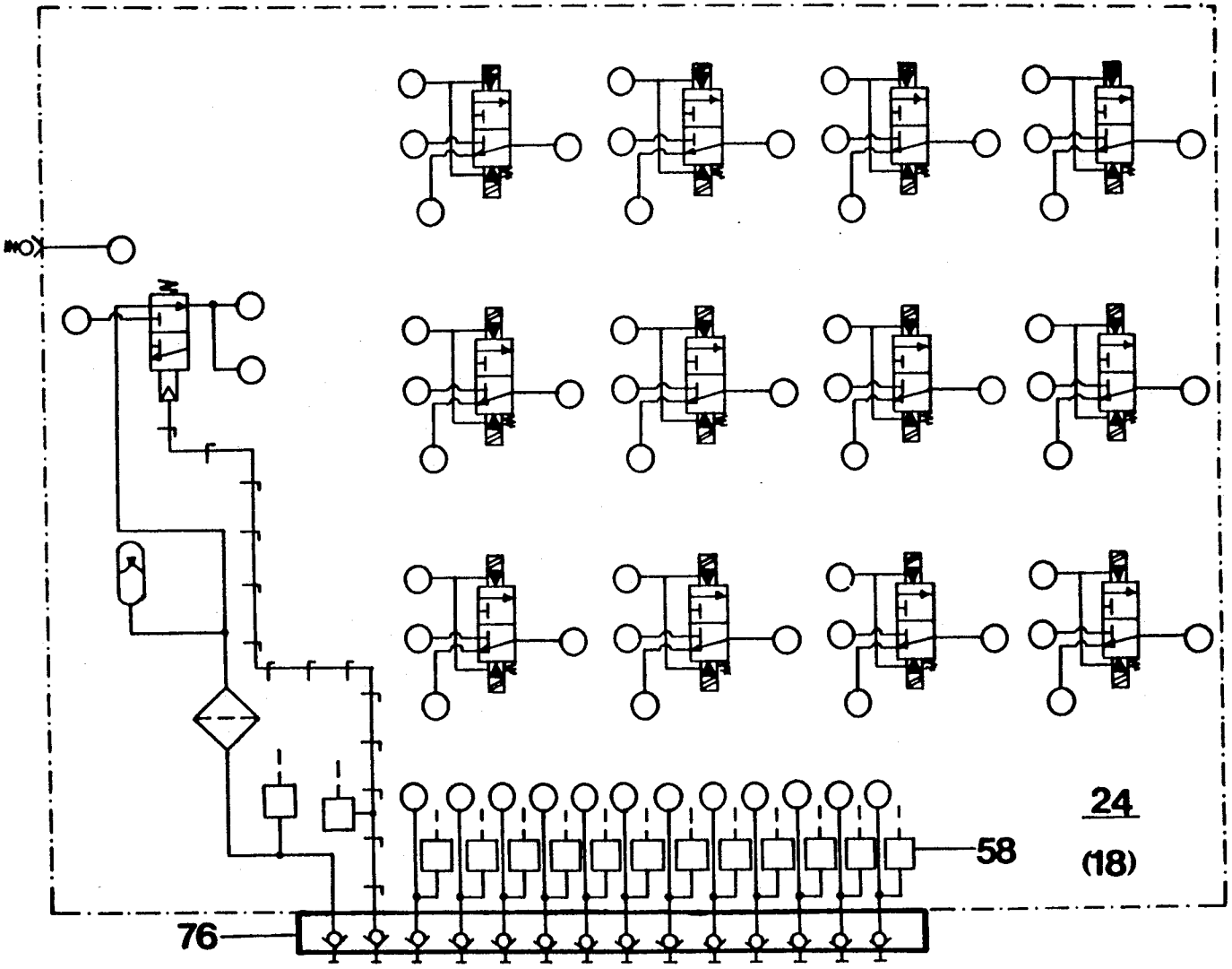
FIG. 7 is a hydraulic flowchart of control for satellite tree module and satellite wet Xmas tree.

FIG. 3 shows hydraulic flowchart of connection 56, of undersea control module, 24, with a local wet Xmas tree, 14, with pressurestats, 58. FIG. 4 shows a flowchart of hydraulic interfaces of tree-cap, 60, top of WXT, 62, and local WXT, 14; seat, 64, of U.C.M. 24 and connection terminal of manifold, 66 being shown. FIGS. 5 and 6 flowcharts of hydraulic interfaces with satellite tree module, 18, and structure of flow line, 16, being shown in FIG. 5, and connecting plate 68, to satellite tree module, 18, and terminal, 70, for connection with umbilical and satellite WXT, and in FIG. 6 the top of S.T.M. 72, the seat of U.C.M. 62, the terminal to connect manifold, 48, a connecting plate, 72, to the F.L.S, 16; and FIG. 7 shows a hydraulic flowchart of S.T.M., 18 and satellite WXT, connection with S.T.M. 76 being shown.

Figure 8:
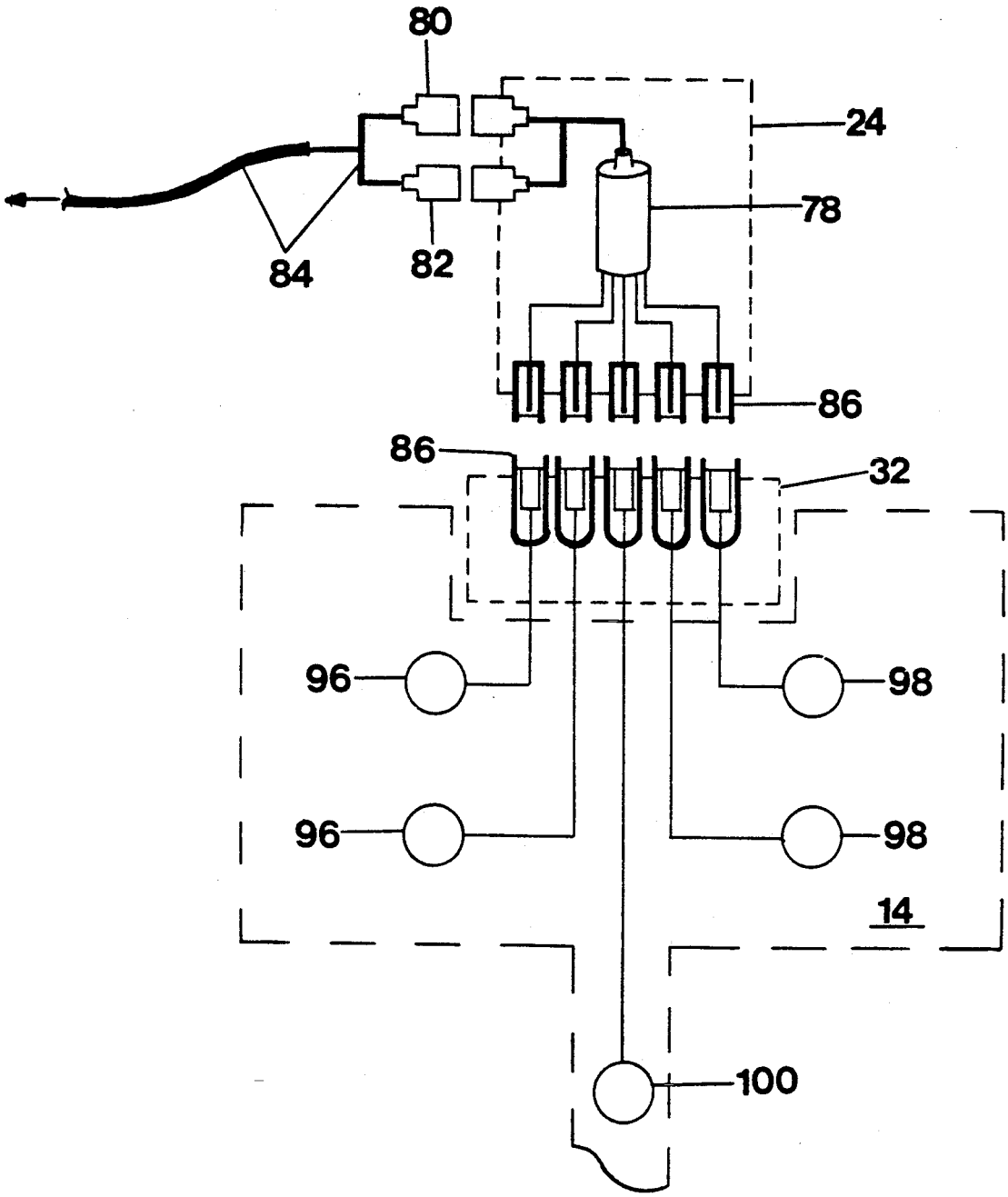
FIG. 8 is a schematic diagram showing electric interfaces with local wet Xmas tree.
Figure 9:
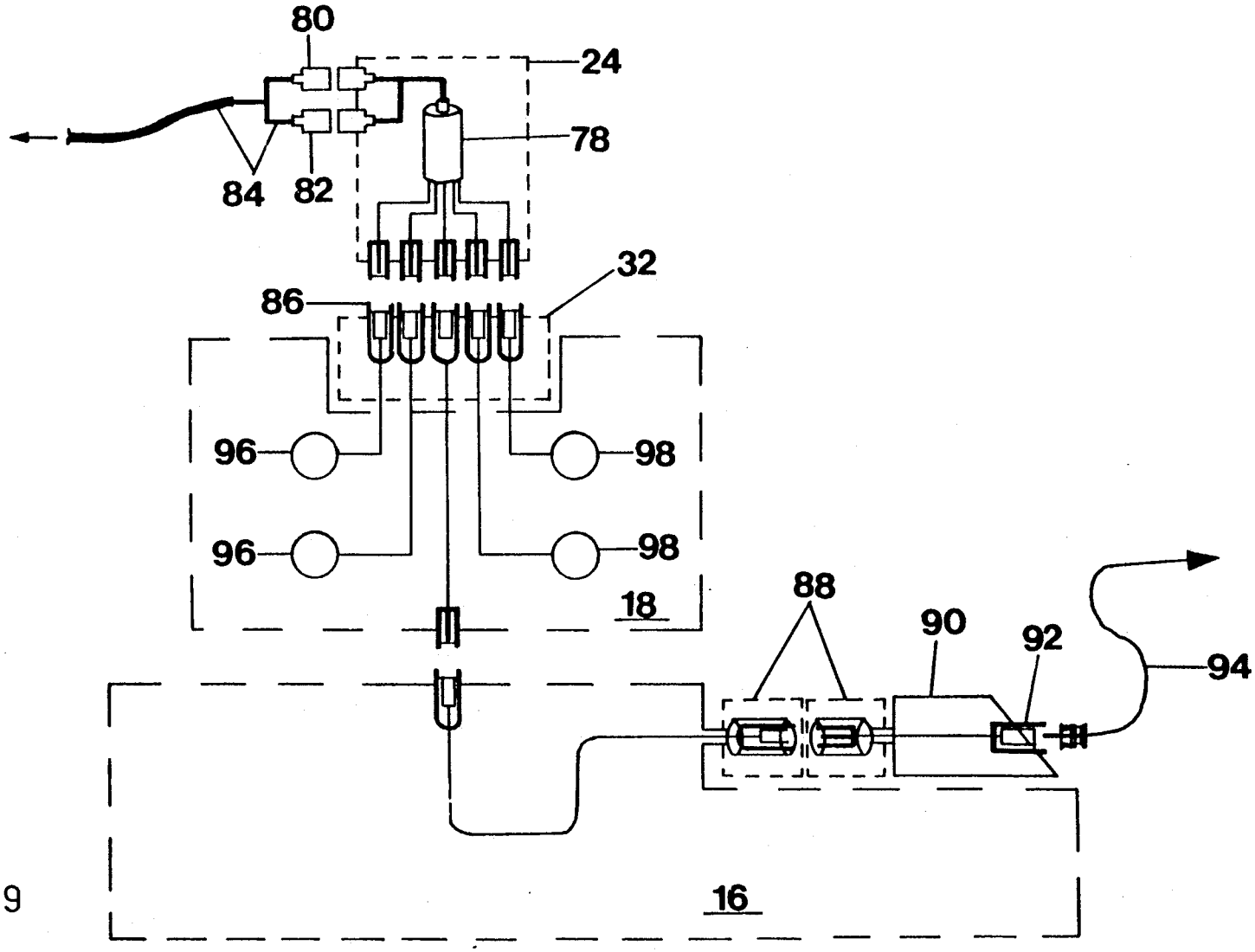
FIG. 9 is a shematic diagram showing electric interfaces with satellite tree module and structure of flow line.
Figure 10:
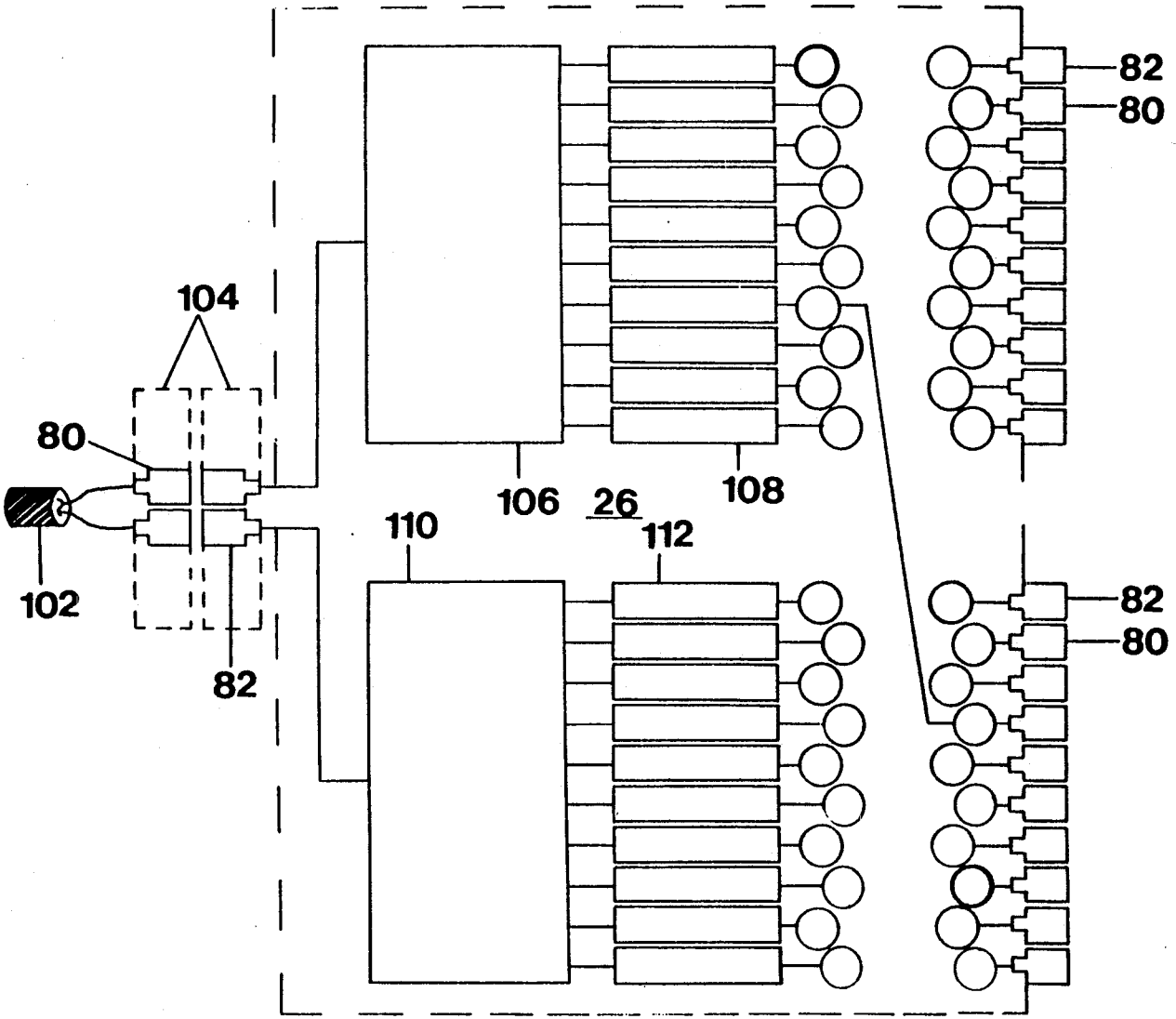
FIG. 10 is a schematic diagram of electric distribution module.

As is to be seen from FIG. 8 which is a schematic diagram of the electrical interfaces of local WXT 14 with U.C.M. 24, the container, 78, is shown with electronic circuits electric power induction connectors 80, signal induction electric connectors, 82, electric jumper, 84, along with connection by R.O.V. with seat of U.C.M. 32, and conduction electric coupling unthreaded connectors, 86, while FIG. 9 is a schematic diagram of electric interfaces of S.T.M. 18 with F.L.S. 16, which shows hubs of horizontal connection, 88, structure of seat, 90, of flow lines and umbilical of control of satellite W.X.T., 22, threaded conducting electric connector, 92, and electric cable, 94, of control umbilical of satellite W.X.T., 22. Also, as is to be seen from FIGS. 8 and 9, each local W.X.T., 14, and S.T.M. 18, will be provided with two pressure transducers 96, and two outside sensors of position of choke valves, 98, while local W.X.T., 14, and satellite W.X.T., 22 may also be provide with a transducer for down-the-hole pressure and temperature (D.P.T.T.), 100. FIG. 10 is a schematic diagram of electric distribution module, 26, showing umbilical, 102, of stationary production unit, hubs, 104, induction electric connectors for power, 80, induction electric connectors for signals, 82, feed arrangement and distribution, 106, with its protection circuits, 108, and arrangement and distribution for signals, 110, with its protection circuits, 112.

Figure 11:
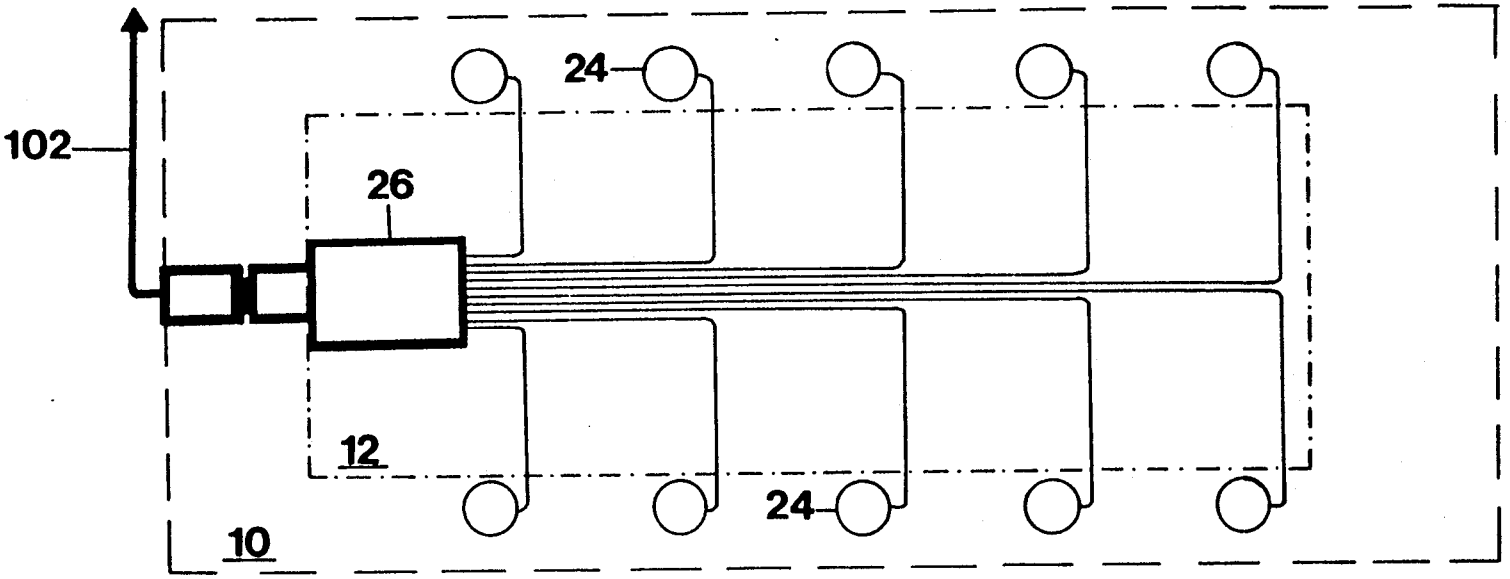
FIG. 11 is a schematic diagram of undersea electric distribution arrangement.
Figure 11A:
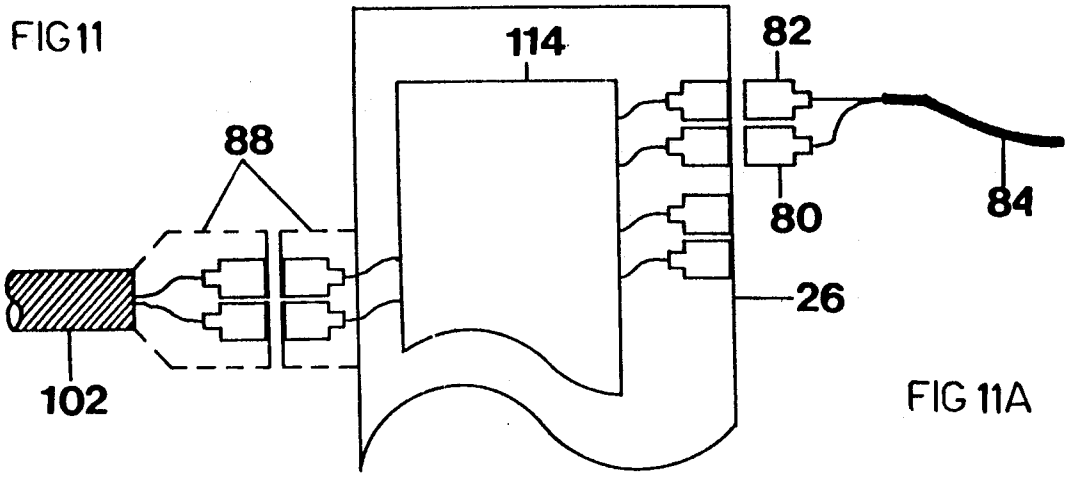
FIG. 11A is an enlarged detail of electric distribution, taken from FIG. 11.

FIGS. 11 and 11A are a schematic diagram of undersea electric distribution and an enlarged detail of E.D.M., 26, takem from FIG. 11, and show template 10, manifold, 12, E.D.M., 26, U.C.M's, 24, and electrical umbilical for V.E.P., 102, (FIG. 11), as well as electrical umbilical for V.E.P. 102, hubs for horizontal connection, 88, power induction electrical connectors, 80, signal induction electrical connectors, 82, protection and distribution circuits, 114, and electric jumper, 84, of remote connection for R.O.V.

Figure 12:
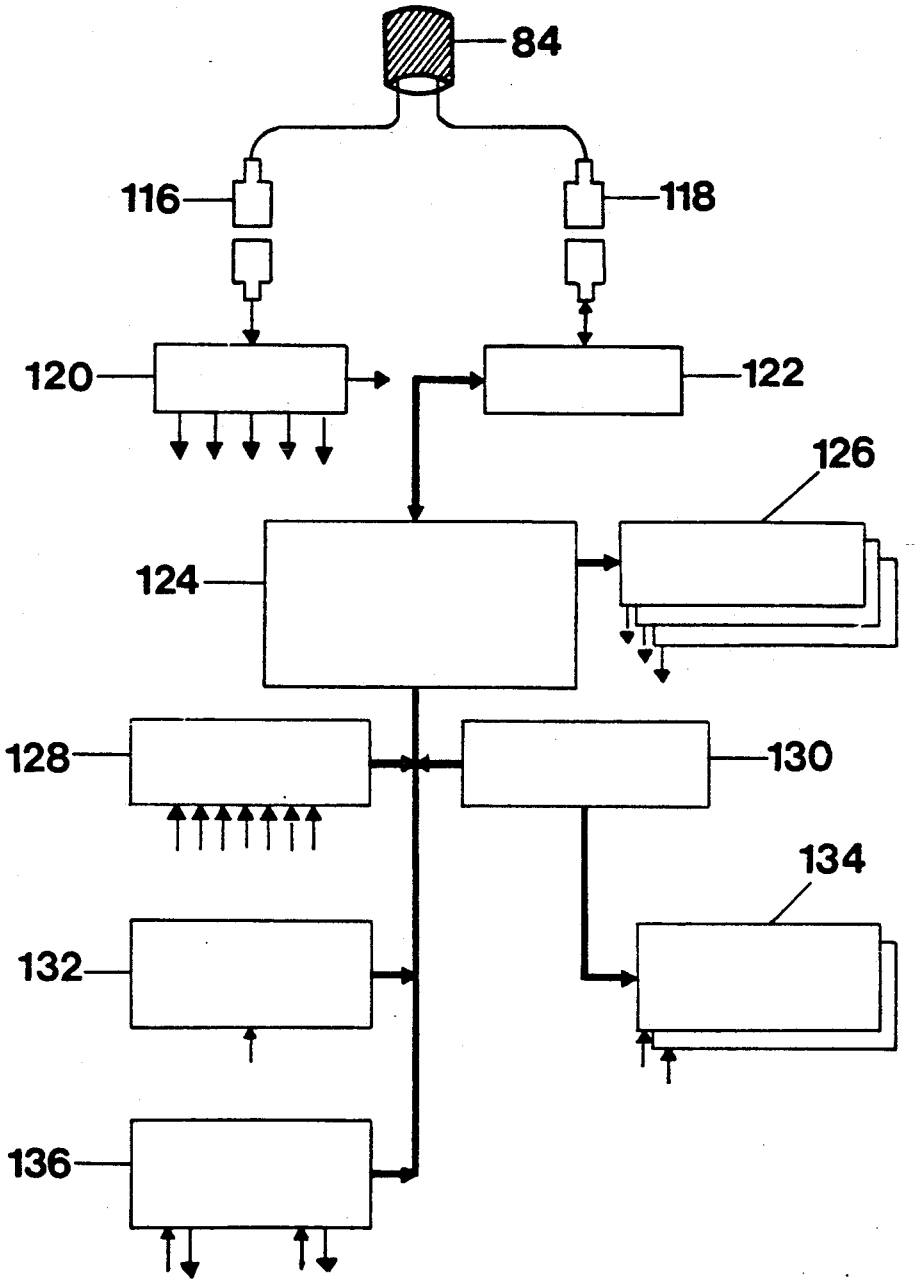
FIG. 12 is a block diagram of preferred electronics for undersea control module.

Finally, FIG. 12 is a block diagram of preferred electronics for undersea control module, 24, showing jumper for electric distribution module, 84, feed induction connector, 116, signal induction connector, 118, power source, 120, communications interface, 122, microprocesser, 124, interface driver for solenoid valve, 126, interfaces for S.P.D.T. switch, 128, A/D converter and multiplexer, 130, signal arranger, and interface for D.P.T.T., 132, signal arranger for pressure transducer, 134, and signal arranger and pressure transducer, 134, and signal arranger and interface for sensor for choke position, 136.

It should be pointed out that though the whole of the control system description has been done based on the undersea production system concerned in the Brazilian patent application Pl 9005123, its main features may be considered as those of other undersea production systems (template-manifold, manifold, wet Xmas trees).

We claim:

1. Multiplexed electrohydraulic type of control system for use in undersea production system consisting of ten undersea control modules (U.C.M's), (24), arranged and installed as one for each local wet Xmas tree, (14), and satellite tree module (S.T.M.), (18) wherein aforesaid control system links up with stationary production unit by means of hydraulic umbilicals, (42) and electric umbilicals, (44) and by means of an electric distribution module (E.D.M.), (26), while electric jumper connection, (84) of aforesaid undersea control module (U.C.M), (24) and of aforesaid electric distribution module (E.D.M.), (26) is done by means of a remotely controlled vehicle (R.O.V.), (30).

2. Multiplexed electrohydraulic type of control system for use in undersea production system according to claim 1, comprising a primary control system of the multiplexed electrohydraulic kind, and also including a secondary hydraulic system as standby for said primary system.

3. Multiplexed electrohydraulic type of control system for use in undersea production system according to claim 1, wherein the hydraulic distribution system is connected to the stationary production unit by hydraulic umbilicals, (42), coming straight from manifold, (12), and the electric distribution is provided with an electric distribution module (E.D.M.), (26), which links such distribution to the electrical umbilical, (44) of the stationary production unit.

4. Multiplexed electrohydraulic type of control system for use in undersea production system according to claim 1, wherein each said hydraulic umbilical, (42) consists of a pressure feed line for said undersea control module (U.C.M.), (24), a pressure line for secondary control, and pressure lines for safety valves.

5. Multiplexed electrohydraulic type of control system for use in undersea production system according to claim 1, wherein at undersea hydraulic distribution each wet Xmas tree (WXT), (20) or satellite tree module (S.T.M.) (18), is provided with control lines by means of its connection to manifold, (12), one line for hydraulic feed of its undersea control module (U.C.M.), (24), one line to drive its secondary control, and one line to drive its safety valve.

6. Multiplexed electrohydraulic type of control system for use in undersea production system according to claim 1, wherein all electric cables, (28), are installed in the manifold, (12), while connection of electric cable (28), to electric distribution module (E.D.M.), (26), and to respective undersea control module (U.C.M.), (24) is done by means of a remotely controlled venicle (R.O.V.), (30).

7. Multiplexed electrohydraulic type of control system for use in undersea production system according to claim 6, wherein electric connection of electric cable (28), from electric distribution module (E.D.M.), (26), is of the induction type, said electric cable, (28), being linked to the undersea control module (U.C.M.), (24), by means of a connector, (34), which can be manipulated by a remotely controlled vehicle (R.O.V.), (30) lying in the upper side part of said undersea control module (U.C.M.), (24).

* * * * *